United States Patent [19]

Santén et al.

[11] Patent Number: 4,687,513

[45] Date of Patent: Aug. 18, 1987

[54] CONDENSATION OF ZINC VAPOR

[75] Inventors: Sven Santén; Börje Johansson, both of Hofors, Sweden

[73] Assignee: SKF Steel Engineering AB, Hofors, Sweden

[21] Appl. No.: 871,740

[22] Filed: Jun. 9, 1986

[30] Foreign Application Priority Data

Jun. 12, 1985 [SE] Sweden ..... 85029288

[51] Int. Cl.[4] ..... C22B 19/04

[52] U.S. Cl. ..... 75/88; 75/86

[58] Field of Search ..... 75/88, 86, 87

[56] References Cited

U.S. PATENT DOCUMENTS 1,921,820 8/1933 Handwerk et al. ..... 75/23

4,042,379 8/1977 Harris ..... 75/88

FOREIGN PATENT DOCUMENTS 2122648 1/1984 United Kingdom .

*Primary Examiner*—Peter D. Rosenberg

*Attorney, Agent, or Firm*—Armstrong, Nikaido, Marmelstein & Kubovcik

[57] ABSTRACT

The present invention relates to a method and means for condensing zinc vapor out of a gas. A substantially coherent curtain (25) of cooling metal is generated, towards which the gas containing zinc vapor is directed. The resultant mixture is expanded in an expansion zone (21*a*) and thereafter accelerated in a compression zone (21*b*), thus ensuring that all parts of the gas are brought into contact with the cooling metal. Particles and drops are then separated by passing the gas over the surface of a bath of cooling metal (28).

7 Claims, 2 Drawing Figures

CONDENSATION OF ZINC VAPOR

Figure 1:
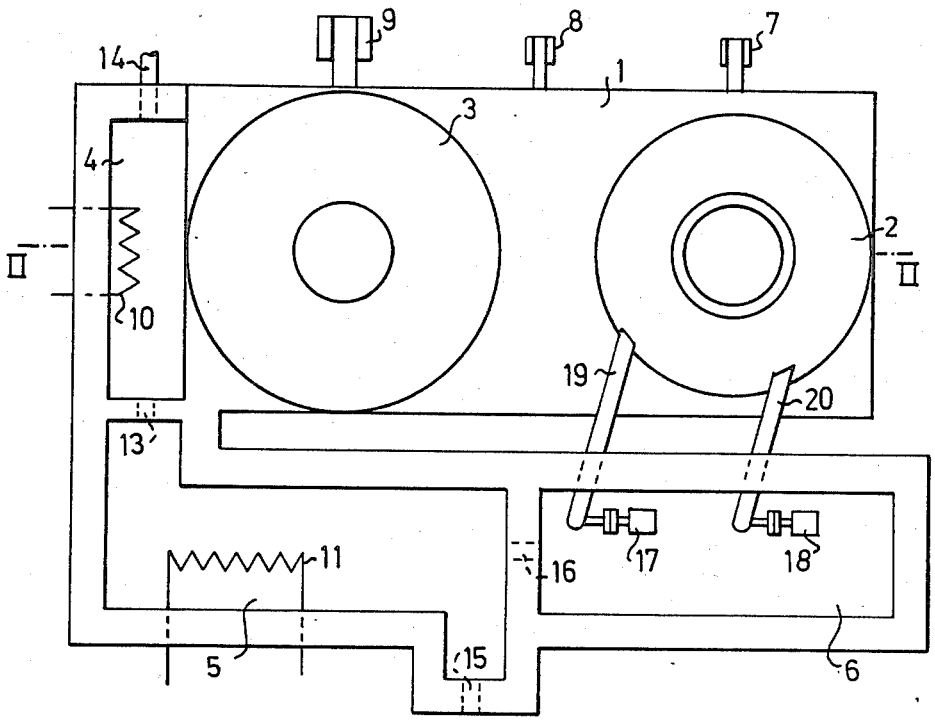

The present invention relates to a method and means for condensing zinc vapour out of a gas by bringing the gas into contact with cooling metal.

Current industrial processes for condensing zinc out of a gas containing zinc vapour utilize liquid lead from which the zinc has been separated by means of liquation. The gas is conducted through a condensor in which lead is thrown out in drop form with the aid of impellers. The zinc condensed out then dissolves in the lead drops.

The method described above has also been used for processes utilizing liquid zinc as cooling medium.

Impellers of graphite usually operate in metal baths maintaining a temperature of about 500° C. Impeller wear, caused by erosion and corrosion due to the high temperature of the molten metal, is a serious problem. It is also difficult to design satisfactory impellers which produce sufficiently fine drops and distribute the drops uniformly in the condensing zone and thus provide effective cooling and condensation of the metal vapour throughout the condensor chamber. Another problem with the known devices is that metal drops accompany the gas when it leaves the condensor.

It has now also been discovered that unsatisfactory cooling effect is obtained when the gas containing zinc vapour comes into contact with the flying drops. Instead the vapour pressure of the cooling metal increases and the zinc vapour is inefficiently condensed out.

Another phenomenon which may occur with the use of impellers is condensation in the gas phase. This gives drops having high surface tension which arrive on the surface of the metal bath and are incapable of penetrating it. This results in kinetic losses of zinc, while the temperature of the gas leaving may still be low.

One object of the present invention is therefore to achieve a highly efficient method of condensing zinc vapour out of a gas flow, at the same time completely freeing the gas from accompanying particles or drops.

A second object of the invention is to effect a means enabling the supply of a large quantity of metal per volume unit of gas and ensuring thorough mixing of gas and metal, but which does not contain any critical movable parts in the bath.

This is achieved in the method according to the present invention comprising the steps of generating an essentially coherent film or curtain of cooling metal, covering substantially the entire cross section through which the gas containing zinc vapour is caused to pass, causing the gas to pass said film or curtain, causing the resultant mixture to expand in at least one step to effect thorough mixing and thereafter accelerating the mixture onto the surface of a cooling metal bath to separate any metal particles or drops present in the gas. Supplying the cooling metal in the form of a film or curtain enables a greater quantity of metal to be introduced into the gas than with previously known methods, thus keeping down the vapour pressure. Allowing the gas to expand then creates a turbulence which effectively atomizes the cooling metal so that substantially all parts of the gas will come into contact with the cooling metal. Another great advantage is that the gas comes into contact with pure coolant containing no dross.

According to one embodiment of the method according to the invention the cooling metal used is lead.

According to another embodiment of the method according to the invention the cooling metal used is zinc.

According to a further embodiment of the method according to the invention, after acceleration in the first step, the gas mixture is caused to expand at least once more before being accelerated onto the surface of the cooling metal bath. This further increases the efficiency with which zinc vapour is condensed out.

According to yet another embodiment of the method according to the invention, after having encountered the surface of the cooling metal bath, the gas is caused to expand in order to substantially completely separate any drops which may have accompanied it.

According to still a further embodiment of the method according to the invention the cooling metal is recirculated after cooling, separation of condensed zinc if lead is used as cooling metal or withdrawing a partflow of the circulating zinc if zinc is used as cooling metal and increasing the temperature of the cooling metal by a few degrees in order to prevent the formation of dross in the means supplying the cooling metal.

The temperature increase can be achieved by effecting heat exchange between the cooling metal and the incoming hot gas containing zinc vapour and/or between the cooling metal entering and that leaving the apparatus.

The means for performing the method according to the invention comprises a condensing section, a separation section, a gas-outlet section, a treating section for cooling metal and a recirculating section for cooling metal, and is characterised in that the condensing section consists of at least one chamber with an expansion area, supply means for the cooling metal arranged in conjunction with the expansion section and an acceleration section after the expansion section.

According to one embodiment of the means according to the invention, the condensing section includes a second chamber located vertically below the first chamber and consisting of an expansion part and an acceleration part.

According to a second embodiment of the means according to the invention, the condensing section is provided with an outlet in communication with the separation section, the gas mixture thus being brought into contact with the cooling metal bath present in the separation section.

According to another embodiment of the means according to the invention the diameter of the gas outlet section is considerably larger than that of the outlet of the condensing part in the separation section.

According to yet another embodiment of the means according to the invention, the chamber or chambers of the condensing section is/are provided at the bottom with a drip edge.

According to still another embodiment of the means according to the invention, the supply means for cooling metal in the condensing section are nozzles distributed around the periphery so that a substantially coherent film or curtain of cooling metal is formed over substantially the entire cross section through which the incoming gas containing zinc vaour will pass.

Figure 2:
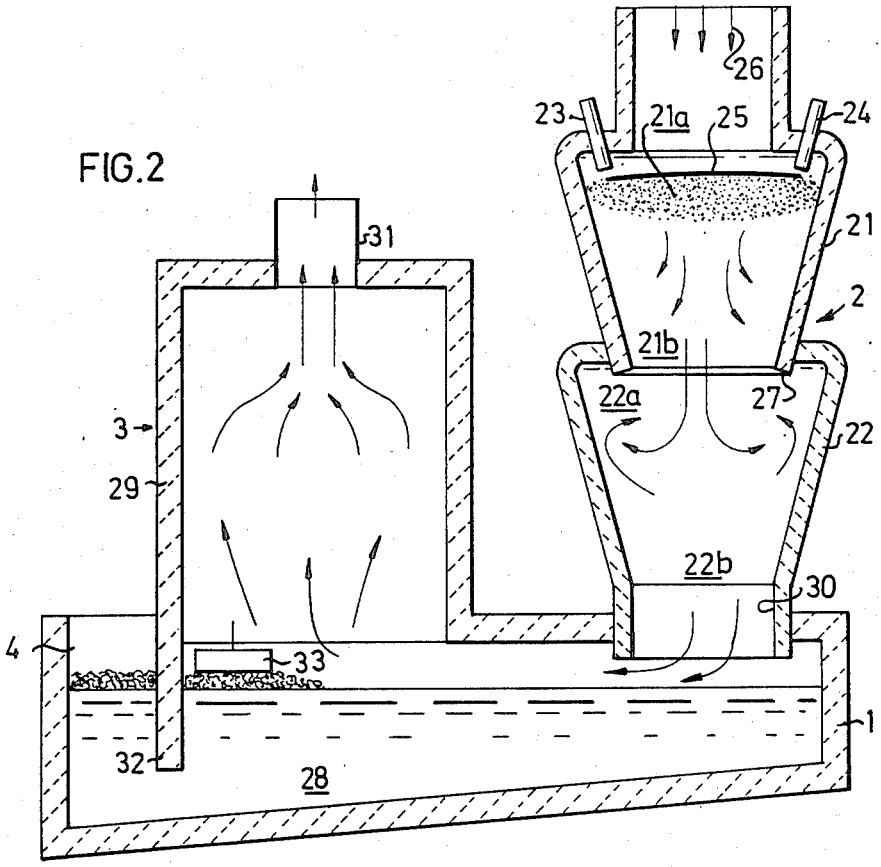

Additional advantages and features of the invention will be revealed in the following detailed description of one embodiment of the invention shown in the accompanying drawings, in which FIG. 1 shows a diagrammatic view from above of one embodiment of the means according to the invention, and FIG. 2 shows a cross section of the means according to FIG. 1, taken along the line II—II.

FIG. 1 shows a diagrammatic view from above of zinc-condensing equipment for performing the method according to the invention, using zinc as cooling metal. If lead is used as cooling metal the zinc will be dissolved in the lead. However, zinc will be condensed out of the gas containing zinc in the same way in both cases.

The equipment thus comprises a condensor chamber 1 with a condensing section 2 and a gas-outlet part 3. The equipment also includes a dross chamber 4, a cooling chamber 5 and a pump sump 6.

The condensor chamber is provided with burners 7, 8 and 9 to maintain its temperature. Cooling losses in the dross chamber are compensated electrically, as indicated by an electric resistance loop 10. The temperature in the cooling chamber is controlled by means of cooling loops 11. The thermal losses in the dross chamber can of course be compensated by oil burners or the like.

The dross chamber communicates with the cooling chamber via a conduit or channel 13, designed so that only zinc can pass and the dross is withdrawn via an outlet 14.

A certain quantity of liquid zinc is removed from the cooling chamber through an outlet 15 while the remainder flows to the pump sump through a connection 16, to be used as coolant. Thermal losses in the sump can be compensated by electric immersion heaters, for instance.

If the cooling metal is lead, after dross removal the lead will flow through a cooling channel at the end of which zinc will be removed after liquation.

Pumps 17, 19, in the sump, pump liquid zinc through conduits 19, 20 to supply means arranged in the condensing section 2. These means are described in more detail with reference to FIG. 2.

To eliminate the risk of solidified zinc forming in pipes and nozzles, a positive temperature gradient is preferably arranged in the pipes from sump to supply means. This can be achieved, for instance, by arranging for the pipes to said means being at least partially heated by the incoming hot gas and/or by arranging for heat exchange to take place with the zinc leaving. Under all circumstances, the pipes should be insulated to prevent excessive temperature losses.

If the cooling metal is lead, heat exchange can be arranged between the incoming lead and the incoming gas and/or lead leaving the condensor since, after separation of the zinc, the lead will otherwise be saturated with zinc which might cause a certain delay before the lead was able to dissolve more zinc if it were not preheated.

FIG. 2 shows a cross section through the equipment according to FIG. 1, taken along the line II—II in FIG. 1. In the embodiment shown, the condensing part consists of two chambers. However, an adequate effect is generally obtained with only one chamber.

The chambers 21, 22 are arranged one above the other and cooling zinc is supplied to the upper part of chamber 21 through nozzles 23, 24 to form a substantially coherent film or curtain 25 of liquid cooling metal. The gas entering, indicated by arrows 26, is caused to pass said curtain and the mixture then flows down into the expansion part 21*a* of the chamber 21. Here, due to the vigorous turbulence, the cooling metal will disintegrate into extremely fine drops and all the gas will come into contact with cooling metal. Drops of cooling metal, together with condensed zinc, will be deposited on the downwardly converging walls of the chamber in the acceleration part 21*b* and will drop down into the cooling metal bath 28 below, by way of the drip edge 27, if any.

After compression in the acceleration part 21*b* of the chamber 21, the gas will again expand in the expansion part 22*a* of the chamber 22. Further mixing is thus effected, and the gas remains longer. In most cases this step is unnecessary to achieve full condensation of zinc vapour present in the gas.

After this condensing step the gas flows on down through the condensor chamber and is deflected against the surface of the zinc bath 28. The drops in the gas are thus substantially completely separated off. The gas continues up through the outlet section 3 which is in the form of a vertical shaft 29, its diameter being considerably larger than the diameter of the outlet 30 from the condensor chamber. Any remaining drops are thus separated and the gas leaves the equipment through the outlet 31, with neither zinc vapour nor accompanying metal drops.

A barrier 32 is arranged in the condensor chamber, below which zinc flows out into the dross chamber 4. Most of the dross is removed from the condensor chamber either intermittently or continuously by suitable means such as a screw feeder, indicated in the drawing by a rake 33.

We claim:

1. A method of condensing zinc vapour out of a gas by bringing the gas into contact with a cooling metal, comprising the steps of generating an essentially coherent film of cooling metal covering substantially the entire cross section through which the gas containing zinc vapour is caused to pass, passing the gas through said film to form a mixture of gas and cooling metal, expanding the resultant mixture in at least one step to effect thorough mixing and thereafter accelerating the mixture and directing the mixture onto the surface of a cooling metal bath to separate any metal particles or drops present in the gas.

2. A method according to claim 1, wherein the cooling metal is lead.

3. A method according to claim 1, wherein the cooling metal is zinc.

4. A method according to claim 1, 2 or 3, wherein after being accelerated, the ga s mixture is expanded at least once more and is then accelerated onto the surface of the cooling metal bath, in order to further increase the efficiency with which zinc vapour is condensed out.

5. A method according to claim 1, 2 or 3, wherein after having been directed onto the surface of the cooling metal bath, the gas is caused to expand in order to substantially completely separate any particles and/or drops which may have accompanied it.

6. A method according to claim 2, wherein the cooling metal is recirculated after cooling, condensed zinc is separated therefrom and the temperature of the cooling metal is increased by a few degrees in order to prevent the formation of dross.

7. A method according to claim 3, wherein the zinc cooling metal is recirculated after cooling, a part-flow of the circulating zinc is withdrawn, and the temperature of the zinc cooling metal is increased by a few degrees in order to prevent the formation of dross.

* * * * *